US009247808B1

(12) United States Patent
Bailey et al.

(10) Patent No.: US 9,247,808 B1
(45) Date of Patent: Feb. 2, 2016

(54) HINGABLE SUPPORT SHELF

(71) Applicants: James Bruce Bailey, Tampa, FL (US); Kimberly Lynn Bailey, Tampa, FL (US)

(72) Inventors: James Bruce Bailey, Tampa, FL (US); Kimberly Lynn Bailey, Tampa, FL (US)

( * ) Notice: Subject to any disclaimer, the term of this patent is extended or adjusted under 35 U.S.C. 154(b) by 0 days.

(21) Appl. No.: 14/641,396

(22) Filed: Mar. 8, 2015

(51) Int. Cl.

| | |
|---|---|
| ***A47B 81/00*** | (2006.01) |
| ***A47B 46/00*** | (2006.01) |
| ***A47B 96/07*** | (2006.01) |
| ***A47B 96/02*** | (2006.01) |

(52) U.S. Cl.
CPC ..... *A47B 46/005* (2013.01); *A47B 96/021* (2013.01); *A47B 96/027* (2013.01); *A47B 96/07* (2013.01)

(58) Field of Classification Search
CPC ..... A47B 46/005; A47B 96/027; A47B 2005/00; A47B 5/00; A47B 83/02; A47B 31/06; B60N 3/004; B60N 3/102
USPC ..... 108/36, 42, 12, 13, 134, 135, 152, 44, 108/160; 248/235, 240, 250; 40/725, 727; 211/90.01, 90.04, 95, 96, 99, 119.003; 297/173, 263
See application file for complete search history.

(56) References Cited

U.S. PATENT DOCUMENTS

| | | | | | |
|---|---|---|---|---|---|
| 279,290 | A * | 6/1883 | Von Der Wulbeke | A47B 5/06 | 108/48 |
| 401,440 | A * | 4/1889 | Keith | 108/13 | |
| 517,633 | A * | 4/1894 | Wortheimer | 297/170 | |
| 820,732 | A * | 5/1906 | Polster | 312/199 | |
| 993,753 | A * | 5/1911 | Casper | 248/235 | |
| 1,348,262 | A * | 8/1920 | Brockway | 312/240 | |
| 1,771,231 | A * | 7/1930 | Parkinson | 297/145 | |
| 2,572,435 | A * | 10/1951 | White | 5/3 | |
| 2,604,142 | A * | 7/1952 | Nelson | A47B 83/02 | 297/112 |
| 3,195,480 | A * | 7/1965 | Meyer | 108/13 | |
| 3,363,341 | A * | 1/1968 | Glassman | 434/417 | |
| 5,408,936 | A * | 4/1995 | Tseng | 108/42 | |
| 6,010,186 | A * | 1/2000 | Tsay | A47B 39/06 | 297/158.4 |
| 6,164,211 | A * | 12/2000 | Faris | 108/11 | |
| 6,290,075 | B1 * | 9/2001 | Cheimets | A47B 46/005 | 211/183 |
| 7,353,911 | B1 * | 4/2008 | Freeman | E04G 5/00 | 182/129 |
| 8,800,188 | B1 * | 8/2014 | Fishelis | A47B 43/006 | 40/711 |
| 2002/0117091 | A1 * | 8/2002 | Stem | 108/13 | |
| 2006/0168863 | A1 * | 8/2006 | Bartholomew | 40/727 | |
| 2011/0278244 | A1 * | 11/2011 | Munyan | 211/13.1 | |
| 2014/0327278 | A1 * | 11/2014 | Curtis et al. | 297/163 | |

FOREIGN PATENT DOCUMENTS

| | | | |
|---|---|---|---|
| CA | 2538466 | * | 9/2006 |
| CH | 109858 | * | 4/1925 |

* cited by examiner

*Primary Examiner* — Janet M Wilkens
(74) *Attorney, Agent, or Firm* — Gulf Coast Intellectual Property Group

(57) ABSTRACT

A support shelf operable to be hingedly secured to a wall wherein the support shelf includes a first portion and a second portion that are different in size and the support shelf is movable so as to provide either the first portion or second portion for supporting an object thereon. The support shelf includes a body having a first portion and a second portion perpendicularly joined. The second portion of the body is smaller than that of the first portion of the body. A hinge is secured to the second portion and is operable to move the support shelf intermediate its first position and its second position. A retaining member is secured to the first portion and is operable to secure objects therein when the support shelf is in its first position. A frame member is included that surroundably mounts the first portion when the body is in its first position.

3 Claims, 3 Drawing Sheets

HINGABLE SUPPORT SHELF

FIELD OF THE INVENTION

The present invention relates to generally to shelving, more specifically but not by way of limitation, a support shelf that is configured to be placed in an area such as but not limited to a bathroom, wherein the support shelf has a first support member and a second support member that are contiguously formed and perpendicular.

BACKGROUND

Shelving and cabinets are well known in the art. The market place today has numerous different types of specialized shelves and/or cabinets that have been designed for specific applications. By way of example but not by way of limitation, there are various types of shelving for tools and other items. Typically, shelves provide a horizontal support structure that allows a user to superpose a desired object or items thereon. In some configurations the shelving is movable most notably in an inward-outward direction. This type of shelving is common and is typically slidably mounted in a cabinet and provides technique for accessing the upper surface of the shelf in its entirety in a more ergonomic manner.

One issue with existing shelving systems is that they are not configurable to provide a support structure of a different size. As previously mentioned herein, conventional shelving provides a single horizontal support surface. If a user desires to utilize a shelf in a more temporary manner and place objects of different sizes thereon, conventional shelving is not configurable to provide optimum and efficient use of space.

Another issue with conventional shelving is its inability to be adaptable to accommodate small areas such as but not limited to bathrooms. Many bathrooms have very limited space and optimization of storage is desired. Conventional shelving is provided for these areas but current shelving technology is not adaptable to provide more than one storage surface within a single shelf unit that can be adapted to accommodate objects of different sizes.

Accordingly, there is a need for a shelving system that is a single unit wherein the shelving system is operable to provide a first support surface and a second support surface that are different in size so as to accommodate an item or items for a user.

SUMMARY OF THE INVENTION

It is the object of the present invention to provide a shelving system that includes a first shelf member and a second shelf member wherein the first shelf member and second shelf member are constructed having different sized surface areas.

Another object of the present invention is to provide a shelving system that includes a first shelf member and a second shelf member that are contiguously formed and perpendicular in orientation.

A further object of the present invention is to provide a shelving system having a contiguous first shelf member and second shelf member wherein the shelving system is hingedly secured to a vertical support wall.

Yet another object of the present invention is to provide a shelving system that includes a first shelf member and a second shelf member that are contiguously formed that includes a first position and a second position, wherein in the first position the first shelf member is perpendicular to the adjacent support wall to which the shelving system is attached.

An additional object of the present invention is to provide a shelving system having a first shelf member and a second shelf member contiguously formed wherein in its second position the second shelf member has been pivoted away from the support wall to which the shelving system is attached and is perpendicular thereto.

Still a further object of the present invention is to provide a shelving system that includes a contiguous first shelf member and second shelf member perpendicular in orientation that includes a hinge secured proximate the union of the first shelf member and second shelf member.

Yet another object of the present invention is to provide a shelving system that is operable to provide a first shelf member of a first size and a second shelf member of a second size that further includes a keeper operable to releasably secure the shelving system in its first position.

An alternative objective of the present invention is to provide a shelving system having a first shelf member and a second shelf member wherein the second shelf member further includes an integral support wall.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
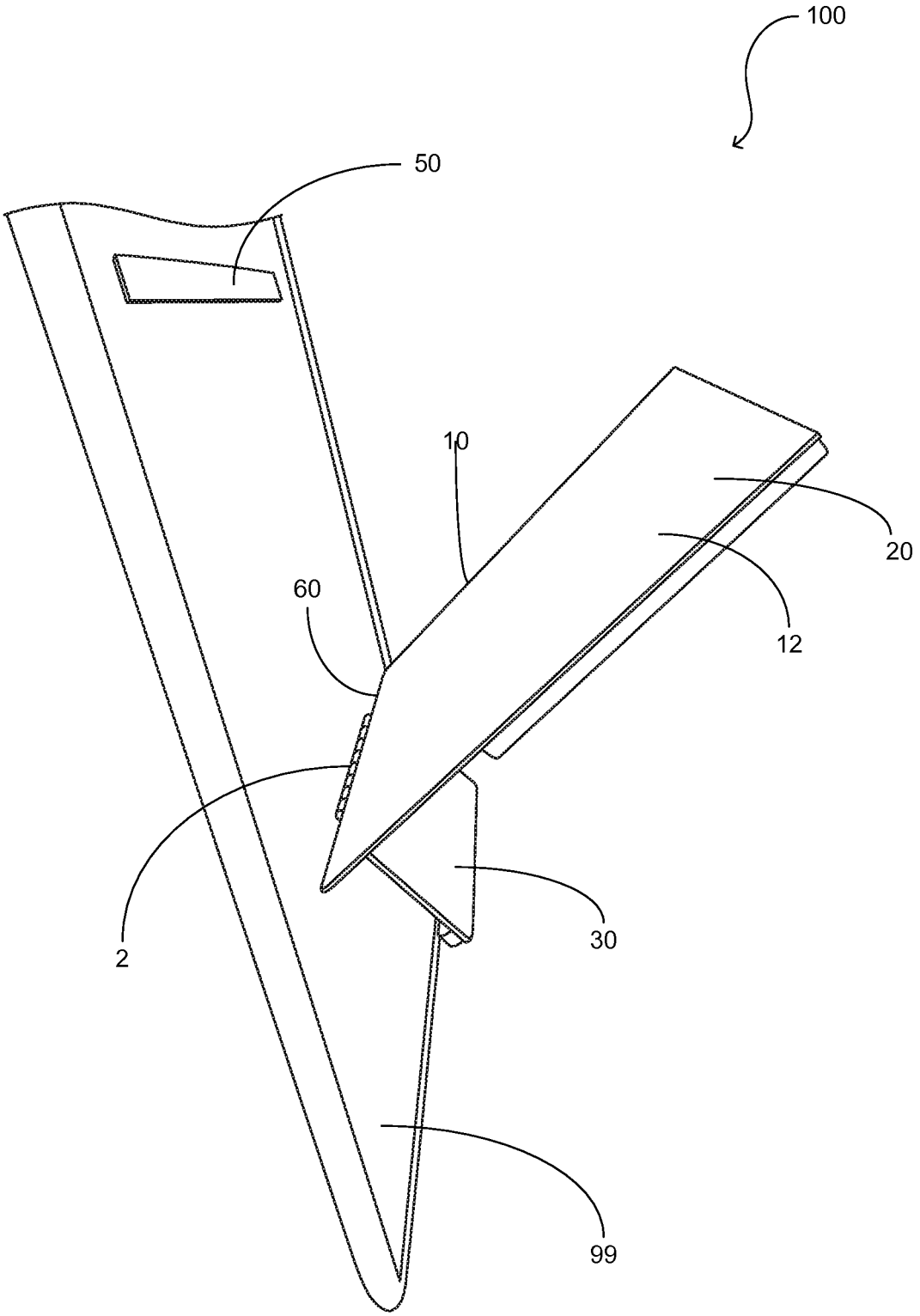
FIG. 1 is a side view of the preferred embodiment of the present invention intermediate its first position and its second position.

Referring now to the drawings submitted herewith, wherein various elements depicted therein are not necessarily drawn to scale and wherein through the views and figures like elements are referenced with identical reference numerals, there is illustrated a hingable support shelf 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to FIG. 1 herein, the hingable support shelf 100 includes a body 10 having an integrally formed first portion 20 and second portion 30. The first portion 20 and second portion 30 are formed utilizing suitable durable techniques and are perpendicular to each other. The body 10 is manufactured from a suitable rigid material such as but not limited to wood or metal. The body 10 is hingedly secured to exemplary wall 99 utilizing hinge 2. The first portion 20 of the body 10 is generally rectangular in shape and includes a first surface 11 and second surface 12. The second surface 12 is adjacent exemplary wall 99 when the hingable support shelf 100 is in its first position. In its first position, illustrated herein in FIGS. 2 and 3, the hingable support shelf 100 is operable to provide the upper surface 31 of the second portion 30 to a user such that the second portion 30 is perpendicular to the exemplary wall 99 so as to provide a suitable support structure for placing smaller items thereon. A keeper 50 secured to the exemplary wall 99 functions to releasably secure the hingable support shelf 100 in its first position. In its preferred embodiment, the keeper 50 is a magnet and the first portion 20 is manufactured from a metal. The keeper 50 is secured to the exemplary wall 99 utilizing suitable durable techniques such as but not limited to chemical adhesives. While in its preferred embodiment the keeper 50 is a magnet, it is contemplated within the scope of the present invention that the keeper 50 could be a mechanical fastener or other suitable type of fastener configured to releasably secure the hingable support shelf in its first position.

In the first position, the upper surface 31 of the second portion 30 is accessible by a user of the hingable support shelf 100 so as to receive objects thereon. The upper surface 31 of the second portion 30 has a surface area that is smaller than that of the surface area of the second surface 12 of the first portion 20. This configuration is desired so as to provide to the user of the hingable support shelf 100 an area configured to retain a small item. The first portion 20 and second portion 30 are contiguously formed proximate edge 60 and are perpendicular in orientation. Hinge 2 is secured proximate edge 60 and is operable to transition the movement of the hingable support shelf 100 between its first position and its second position. Hinge 2 is a conventional hinge and is secured utilizing suitable durable techniques to both the hingable support shelf 100 and the exemplary wall 99.

Referring in particular to FIG. 1, the hingable support shelf 100 is illustrated intermediate its first position and its second position. Once placed in its second position, the first portion 20 will be perpendicular to the exemplary wall 99 and the second surface 12 is presented to a user wherein the second surface 12 provides a larger surface area to receive either a larger object thereon that could not be accommodated by the second portion 30 or so as to receive a plurality of objects thereon.

Figure 3:
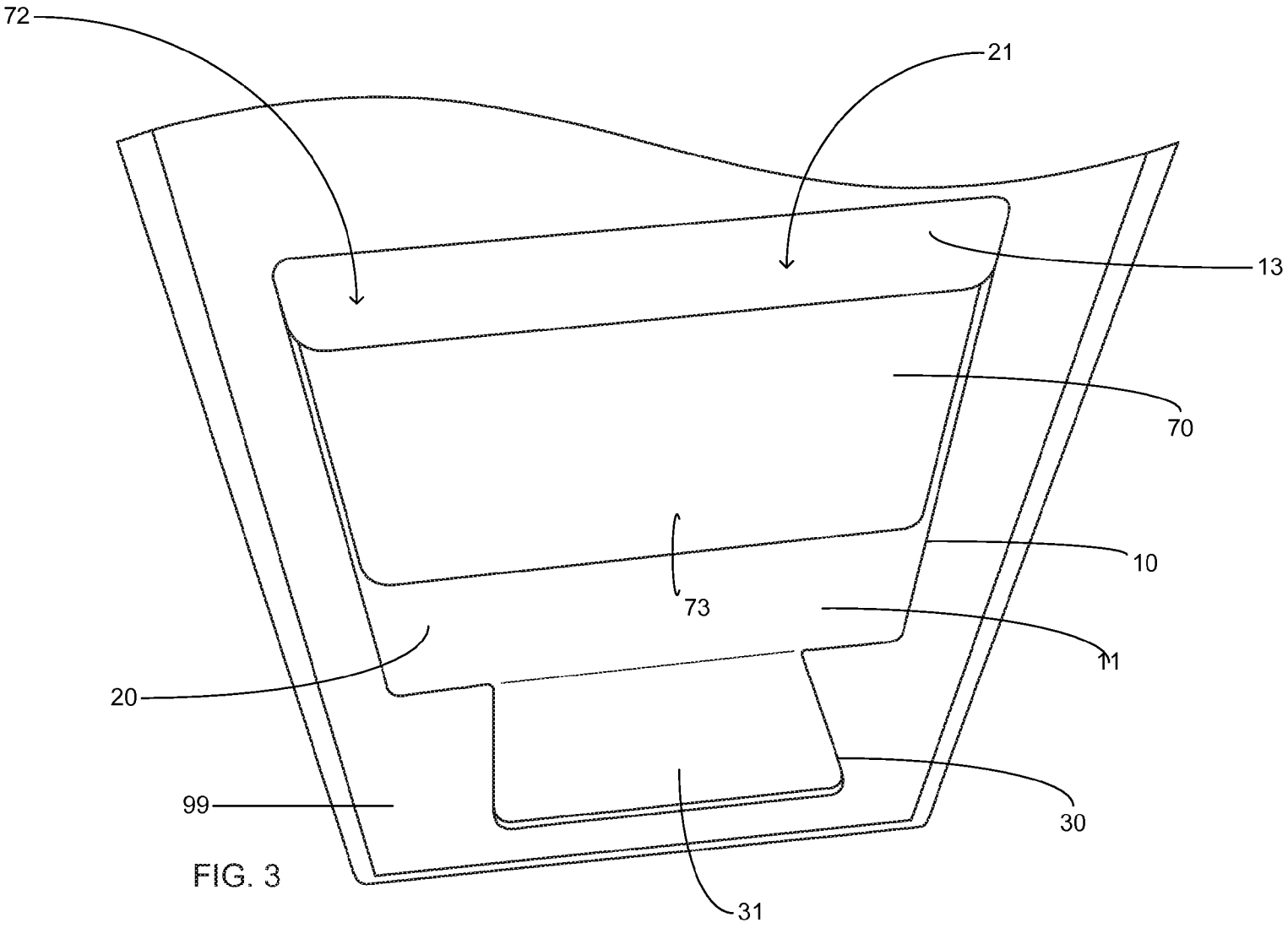
FIG. 3 is a top front view of the present invention.

Referring in particular to FIG. 3 herein, the first portion 20 further includes retaining member 70 secured to the first surface 13 thereof. The retaining member 70 is integrally secured to the first portion 20 utilizing suitable durable techniques. The retaining member 70 extends substantially across the width of the first portion 20 and is formed so as to create a void 72 intermediate the retaining member 70 and the first surface 13. Opening 71 provides access to the void 72 so as to facilitate the placement of objects therein such as but not limited to magazines. Opposite the opening 71 is bottom edge 73. It is contemplated within the scope of the present invention that the bottom edge 73 could be open such that any article placed within the void 72 would extend downwards therefrom and engage the second portion 30. Alternatively, the bottom edge 73 could be coupled with the first surface 13 so as to inhibit objects placed within the void 72 from egressing therepast. The retaining member 70 is manufactured from a suitable durable material such as but not limited to wood or metal.

Figure 2:
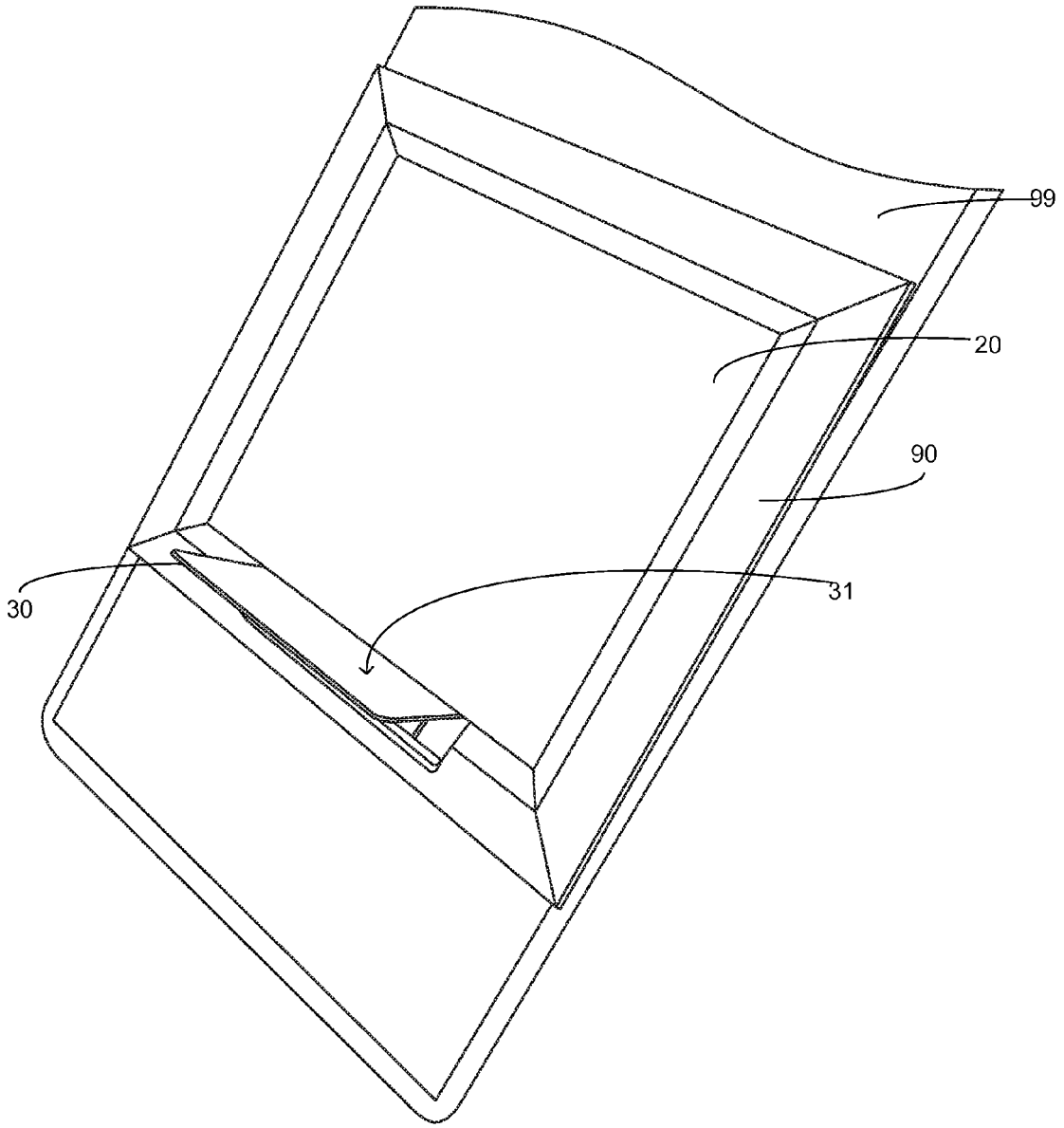
FIG. 2 is a perspective view of the present invention including a frame element.

Referring in particular to FIG. 2 herein, the hingable support shelf 100 is illustrated therein with frame member 90. Frame member 90 is secured to exemplary wall 99 utilizing suitable durable techniques. Frame member 90 is constructed so as to surroundably mount first portion 20 when first portion 20 is secured adjacent to the exemplary wall. Frame member 90 is manufactured to be of mateable shape with first portion 20. While in the preferred embodiment herein the first portion is illustrated as being rectangular in shape, it is contemplated within the scope of the present invention that the first portion 20 could be manufactured in numerous different shapes and as such the frame member 90 would be manufactured to mateable couple therewith when the hingable support shelf 100 is in its first position.

Referring to FIG. 1 and FIG. 3 herein, a description of the operation of the hingable support shelf 100 is as follows. In use, the hingable support shelf 100 is secured to an exemplary wall 99 utilizing hinge 2 and keeper 50. In its first position, shown in FIG. 3, the second portion 30 is perpendicular to the exemplary wall 99 and is operable to provide support for a smaller object. If a user desires support for a larger object, the hingable support shelf 100 is transitioned to its second position wherein the first portion 20 is released from the exemplary wall, shown in FIG. 1, and is moved such that the first portion 20 is perpendicular to the exemplary wall 99 so as to provide a larger surface for placing objects thereon.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A shelf operable to be mounted to a support wall wherein the shelf is configured to transition between a first position and a second position comprising:

a body, said body being manufactured from a rigid material, said body having a first portion and a second portion, said first portion having an upper edge and a lower edge, said second portion having an upper edge and a lower edge, said first portion and said second portion being perpendicular, said first portion and said second portion joined proximate said lower edge of said second portion and said lower edge of said first portion, said second portion having a width that is less than that of said first portion, said second portion being centrally contiguous with said lower edge of said first portion so as to expose a portion of the lower edge of said first portion on either side thereof, said first portion having a first side and a second side, said second portion having a first side and a second side, said body having a first position and a second position;

a retaining member, said retaining member secured to said second side of said first portion of said body, said retaining member having a contiguous wall operable to form a void between said second side of said first portion and said wall, said retaining member having an upper opening and a lower opening so as to receive objects therein;

a hinge, said hinge being secured proximate said bottom edge, said hinge operable to transition said body intermediate said first position and said second position;

a frame member, said frame member being secured to the support wall, said frame member configured to surroundably mount said first portion of said body when said body is in said first position; and wherein in said first position said first side of said first portion is adjacent to the support wall and said second portion is extending perpendicular therefrom.

2. The shelf as recited in claim 1, wherein in said second position, said body is oriented such that said first portion is perpendicular to the support wall and said second portion is adjacent to the support wall so as to provide said first side of said first portion to support an object thereon.

3. The shelf as recited in claim 2, and further including a keeper, said keeper operable to releasably secure said body in said first position, said keeper being mounted to the support wall.

* * * * *